United States Patent [19]

Carter

[11] 4,070,755

[45] Jan. 31, 1978

[54] IMPACT EXTRACTION TOOL

[75] Inventor: Clyde Thomas Carter, Shermans Dale, Pa.

[73] Assignee: AMP Incorporated, Harrisburg, Pa.

[21] Appl. No.: 704,143

[22] Filed: July 12, 1976

[51] Int. Cl.[2] ..... H01R 43/00

[52] U.S. Cl. ..... 29/764; 29/758; 173/120

[58] Field of Search ..... 29/203 H, 203 HM, 203 B, 29/200 D, 739, 764, 758; 173/119, 120, 121

[56] References Cited

U.S. PATENT DOCUMENTS

| | | | |
|---|---|---|---|
| 2,787,178 | 4/1957 | Maxim | 173/119 |
| 3,279,044 | 10/1966 | Roper | 29/203 H |
| 3,385,380 | 5/1968 | Waller | 173/119 |
| 3,624,887 | 12/1971 | Hilbert | 29/203 H |

*Primary Examiner*—Carl E. Hall

*Attorney, Agent, or Firm*—Russell J. Egan

[57] ABSTRACT

An impact extraction tool is disclosed for driving contacts from housings, circuit boards, and the like. The tool is adapted to extract contacts of substantially any post length and even contacts having posts lying under flush with respect to the supporting surface. The tool has a floating cocking spring and thus is shorter than similar tools.

6 Claims, 4 Drawing Figures

IMPACT EXTRACTION TOOL

BACKGROUND OF THE INVENTION

1. The Field of the Invention

The present invention relates to an impact tool for removing electrical contact elements from connectors, circuit boards, and the like.

2. The Prior Art

The use of terminal pins and posts in the electrical equipment is old and well established. In recent years it has become common practice, when terminal pins and posts are required, to provide bodies of dielectric or insulating material to support and carry the pins or posts. The pin supporting bodies are provided with through openings in which the pins or posts are engaged. Originally the pins and posts were press fitted into the openings in the body but, due to the tendency for such a connection to fail, various types of locking means have been developed. Most practical and widely used means for retaining such pins or posts in their related openings in the carrier bodies have involved a stop flange in the opening in the body, a cooperating stop shouder on the pin or post to engage one side of the flange and a snap ring or like expansable element or part on the pin to engage the other side of the flange. In such structures the snap ring or expansable part on the pin or post occurs within the opening in which the pin is engaged and is not accessible. As a result of this relationship of parts it is frequently impossible to remove such pins or posts from their carrier bodies without damage to the bodies or without the aid of specially constructed removal tools which can be inserted into the annulus normally occuring between the pin and the wall of the opening in which the pin is engaged and which will collapse or compress the snap ring or member to make it impossible to remove the pin.

There are a number of well known tools that are useful in both inserting and extracting tapered pin electrical contacts of the type discussed above. Examples of these tools may be found in U.S. Pat. Nos. 2,960,864; 2,962,807; 2,976,608; and 3,135,147.

SUMMARY OF THE INVENTION

The subject invention concerns an improved impact extraction tool which will drive contacts of substantially any post and length from a printed circuit board, connector housing, or the like. The tool in general includes a barrel body having on one end a housing for receiving and setting the connector to be engaged. Movable within the housing is an impact delivering mechanism operable to impart a driving force applying impact from a spring actuated hammer to the contact to be removed.

It is therefore an object of the present invention to produce an improved tool for driving contacts from connector boards and the like.

It is a further object of the present invention to produce an improved impact tool for driving friction mounted pins, terminals, and the like from printed circuit boards and the like.

It is a further object of the present invention to produce an improved extraction tool which will work on contacts having posts of substantially any length as well as with posts lying beneath the surface in which the contact is mounted.

It is a further object of the present invention to produce an impact extraction tool which can be readily and economically manufactured.

The means for accomplishing the foregoing objects and other advantages will become apparent to those skilled in the art from the following description taken with reference to the accompanying drawings.

DETAILED DESCRIPTION OF THE PREFERRED EMBODIMENT

Figure 1:
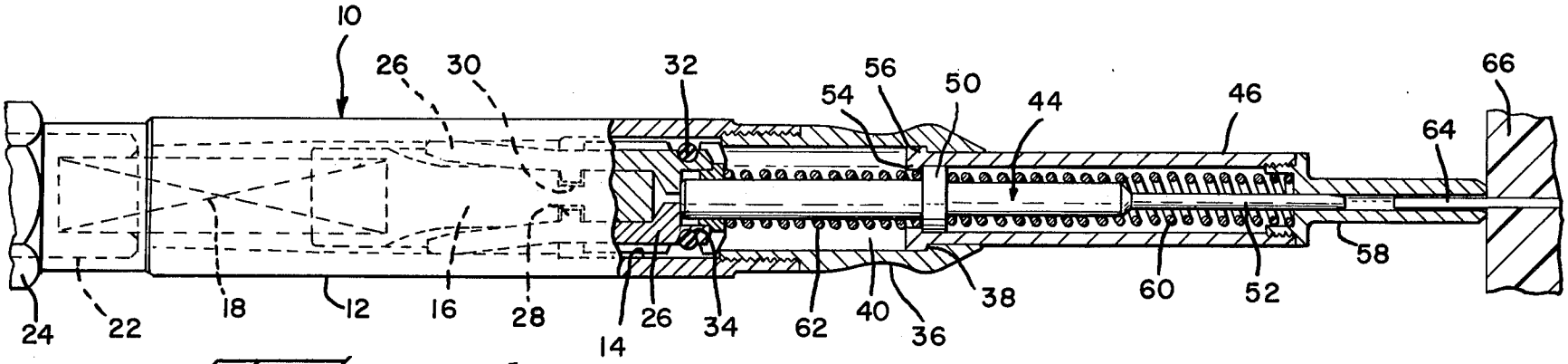
FIG. 1 is a side elevation, partly in section, of the subject tool as it would appear upon initial enagement with a contact to be removed.
Figure 2:
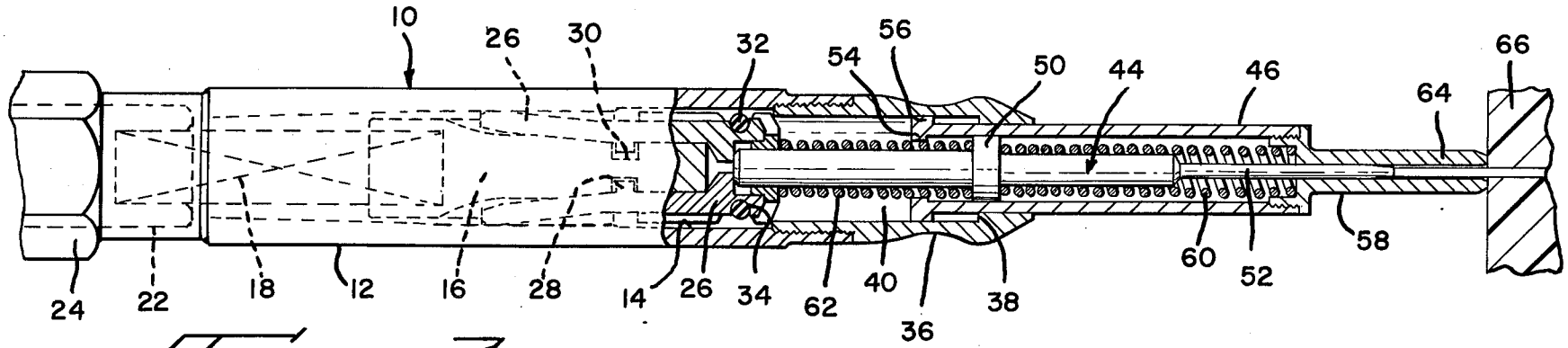
FIG. 2 is a side elevation, similar to FIG. 1, showing the initial compression of the subject tool.

The subject tool includes a barrel body 12 having a profiled axial bore 14. A hammer 16 is mounted for axial movement within the bore and biased to the position shown in FIG. 1 by helical compression spring 18. One end of spring 18 is received in recess 120 in hammer 16 while the other end lies in a compression adjustment mechanism 22 within end cap 24. The trigger 26 has an inwardly directed flange 28 which engages in an annular recess 30 in the hammer 16. An annular trigger retainer member 32 of resilient material lies in an annular groove 34 at the forward end of the trigger 26. A housing cap 36 is threaded into the forward end of the barrel body 12 and has an inner annular shoulder 38 near the forward end of its through bore 40. A plunger 44 is mounted in bore 40 for axial movement therealong together with the plunger housing 46. The plunger 44 is an integral member with a shank portion 48, an enlarged band 50, and a narrow impact portion 52. The plunger housing 46 is a tubular member having inwardly and outwardly directed flanges 54, 56, respectively, on one end and is threaded on the opposite end to receive post sleeve 58. The plunger 44 is mounted in the bore of the plunger housing with spring 60 positioned between post sleeve 58 and band 50. The plunger 44 is retained in the plunger housing 46 by engagement of band 50 against flange 54. The plunger housing 46 is positioned in bore 40 of housing cap 36 with spring 62 biasing the plunger and plunger housing to the right as shown.

Figure 3:
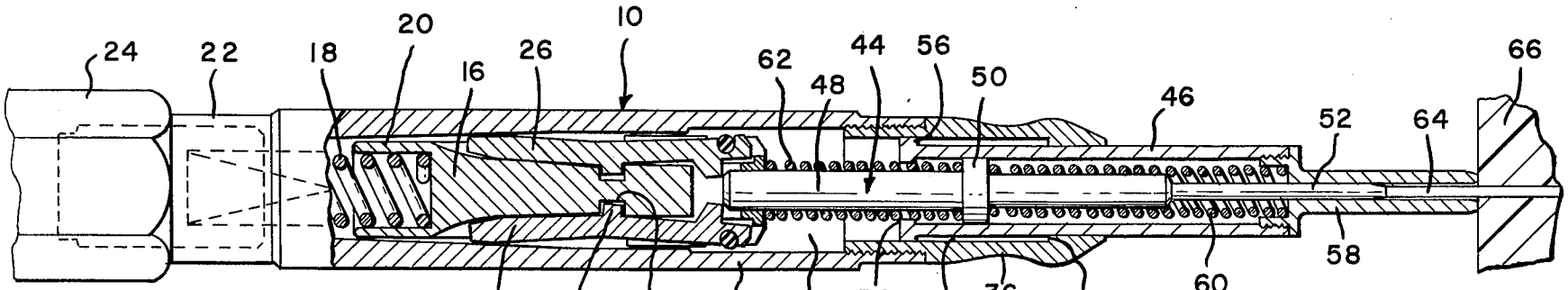
FIG. 3 is a side elevation, similar to FIGS. 1 and 2, showing the subject tool in a fully compressed condition and immediately before delivery of an impact force to the contact.
Figure 4:
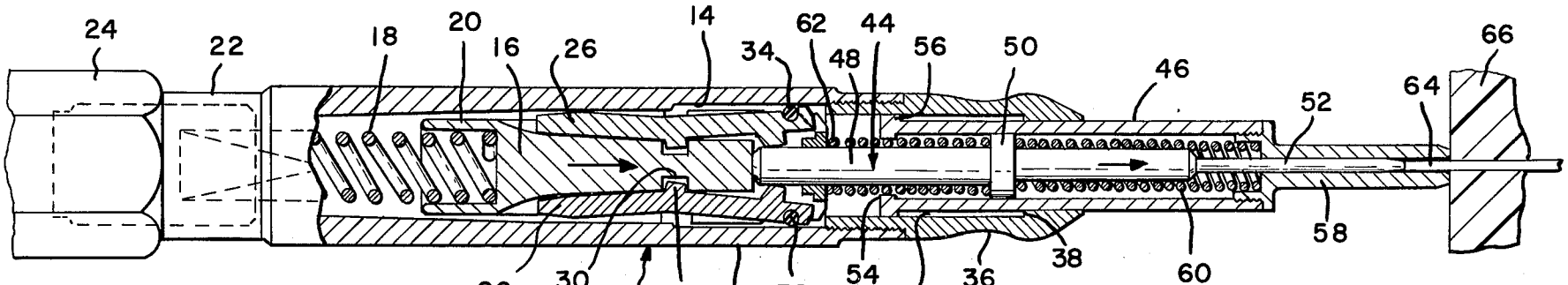
FIG. 4 is a side elevation, similar to FIGS. 1 to 3, showing the tool after delivering an impact blow to the contact.

In operation the tool 10 would be applied against the post 64 of the contact to be removed from a mounting 66 in the manner shown in FIG. 1. The initial forward movement of the tool will cause the floating spring 60 to be compressed allowing the impact portion 52 of the plunger 44 to engage the contact 64. The continued forward movement of the tool causes the spring 62 to be compressed driving the plunger 44 backwards against the trigger assembly, as shown in FIG. 3. When the trigger mechanism is released, the hammer 16 will be driven forward by the spring 18 to transmit an impact on the plunger to effect a successful removal of the contact 64 from the mounting member 66 as shown in FIG. 4.

The tool may be used to extract contacts that have broken off the surface of the mounting media by allowing the impact portion of the plunger to extend beyond the end of the post sleeve.

The present invention may be subject to many modifications and changes without departing from the spirit or essential characteristics thereof. The present invention is therefore to be considered in all respects as illustrative and not restrictive of the scope of the invention.

I claim:

1. An impact extraction tool for driving friction mounted contacts from apertures in printed circuit boards, electrical connectors, and the like, said tool comprising:

a hollow tubular tool body member;

a hammer body movably mounted within said tool body member;

first spring means mounted between one end of said tool body member and said hammer;

trigger means within said tool body member and controlling release of said hammer;

a cap housing assembly secured to the other end of said tool body member and including a cylindrical housing cap and a plunger housing sliding coaxially within said housing cap;

a plunger movably positioned within said plunger housing and having a first end portion for actuating said trigger means and a second end portion for engaging said contact;

second and third spring means biasing said plunger with respect to said trigger and said plunger with respect to said plunger housing, respectively, whereby predetermined movement of said plunger causes movement of said plunger housing prior to the tripping of said trigger at which time an impact is delivered by the hammer body to the plunger to drive the contact from its seat.

2. An impact extraction tool according to claim 1 further comprising:

means to adjust said first spring means whereby the impact force is controlled.

3. An impact extraction tool according to claim 1 further comprising:

means on said housing cap and said plunger housing limiting the relative movement therebetween.

4. An impact extraction tool according to claim 1 wherein:

said second portion of said plunger is of sufficient length to extend beyond the end of said cap housing immediately after impact.

5. An extraction tool for delivering an impact to a friction mounted electrical contact, said tool comprising:

a hollow tubular housing member;

a hammer body movably mounted within said housing member;

spring adjustment means closing one end of said housing member;

first compression spring means interposed between one end of said hammer body and said spring adjustment means;

trigger means within said housing member engaging against the other end of said hammer body, said trigger means controlling release of said hammer body; and a cap assembly secured to the other end of said housing member and including a cylindrical cap housing, an axial bore passing therethrough and an integral inwardly directed flange on the free end of said cap housing, and a cylindrical plunger housing coaxial with and movable within the bore of said cap housing, said plunger housing having an integral outwardly directed flange engageable with the flange of said cap housing to limit the relative movement therebetween;

a plunger movably mounted in said cap assembly and having a contact engaging portion and a trigger engaging portion, said contact engaging portion being of sufficient length to extend beyond said cap housing after impact;

first and second spring means in said housing biasing said plunger to a normal position with respect to said trigger means and said plunger housing whereby predetermined inwardly telescoping movement of said plunger and plunger housing causes tripping of said trigger means at which time the hammer body imparts an impact to said plunger.

6. An impact tool for driving frictionally mounted components from their seats comprising:

a hollow elongated cylindrical handle;

a shaft assembly telescopically disposed in said handle for limited extending and retracting movements with respect thereto, said shaft assembly including a plunger having one end profiled for engaging a contact, a plunger housing coaxial with said plunger and said handle and first and second spring means mounted to bias said plunger and said plunger housing to a normal position with respect to each other and to said handle;

a hammer member mounted in said handle in axially aligned relationship with the other end of said plunger for longitudinal movements alternately in oppositely directions;

yielding resilient means biasing said hammer member toward said plunger; and a trigger mechanism intermediate said hammer member and the other end of said plunger which transmits inward telescoping movement of said shaft assembly to compression of said yielding resilient means, until, upon exceeding a predetermined inward telescoping movement, said hammer is released to impart to said plunger.

* * * * *

UNITED STATES PATENT OFFICE

CERTIFICATE OF CORRECTION

Patent No. 4,070,755 Dated January 31, 1978

Inventor(s) CLYDE THOMAS CARTER

It is certified that error appears in the above-identified patent and that said Letters Patent are hereby corrected as shown below:

Column 4, line 46, "oppositely" should read - - - opposite - - - .

Column 4, line 55, after "impart" it should read - - - an impact to said plunger - - - .

Signed and Sealed this

Sixteenth Day of May 1978

[SEAL]

Attest:

RUTH C. MASON
Attesting Officer

LUTRELLE F. PARKER
Acting Commissioner of Patents and Trademarks